US006841734B2

(12) United States Patent
Goldlust et al.

(10) Patent No.: US 6,841,734 B2
(45) Date of Patent: Jan. 11, 2005

(54) FLEXIBLE HIGH-VOLTAGE CABLE

(76) Inventors: Jerry A. Goldlust, Dielectric Sciences, Inc., 88 Turnpike Rd., Chelmsford, MA (US) 01824; Stephen J. Rigby, Dielectric Sciences, Inc., 88 Turnpike Rd., Chelmsford, MA (US) 01824; Andrew Sabiston, Crete Hall Rd., Gravesend, DA11 9AP (GB)

( * ) Notice: Subject to any disclaimer, the term of this patent is extended or adjusted under 35 U.S.C. 154(b) by 0 days.

(21) Appl. No.: 10/429,182

(22) Filed: May 2, 2003

(65) Prior Publication Data

US 2004/0065469 A1 Apr. 8, 2004

Related U.S. Application Data

(60) Provisional application No. 60/377,909, filed on May 3, 2002.

(51) Int. Cl.[7] ..... H01B 7/18; H01B 7/00

(52) U.S. Cl. ..... 174/102 R; 174/113 R; 174/120 R

(58) Field of Search ..... 174/36, 102 R, 174/105 SC, 120 SC, 120 SR; 428/58, 76, 930

(56) References Cited

U.S. PATENT DOCUMENTS

| | | | | | |
|---|---|---|---|---|---|
| 4,063,089 | A | * | 12/1977 | Gamba | 378/45 |
| 4,129,552 | A | | 12/1978 | Galaj et al. | |
| 4,576,827 | A | | 3/1986 | Hastings et al. | |
| 4,623,755 | A | * | 11/1986 | Henkel et al. | 174/110 SR |
| 4,767,894 | A | * | 8/1988 | Schombourg | 174/106 SC |
| 5,246,783 | A | * | 9/1993 | Spenadel et al. | 428/461 |
| 5,719,218 | A | * | 2/1998 | Sarma | 524/100 |
| 5,874,513 | A | * | 2/1999 | Watanabe et al. | 526/348.1 |
| 6,259,030 | B1 | * | 7/2001 | Tanigawa et al. | 174/108 |
| 6,270,856 | B1 | * | 8/2001 | Hendewerk et al. | 427/487 |
| 6,455,769 | B1 | * | 9/2002 | Belli et al. | 174/23 C |
| 6,479,590 | B1 | * | 11/2002 | Ikeda et al. | 525/193 |
| 6,492,475 | B1 | * | 12/2002 | Egashira et al. | 526/153 |
| 6,524,702 | B1 | * | 2/2003 | Betso et al. | 428/379 |
| 6,586,509 | B1 | * | 7/2003 | Bostrom et al. | 524/302 |
| 2002/0150757 | A1 | * | 10/2002 | Luigi et al. | 428/375 |
| 2003/0087976 | A1 | * | 5/2003 | Bambara et al. | 521/144 |

FOREIGN PATENT DOCUMENTS

| | | |
|---|---|---|
| EP | 089 490 | 9/1983 |
| FR | 2 456 374 | 12/1980 |

* cited by examiner

*Primary Examiner*—William H. Mayo, III
(74) *Attorney, Agent, or Firm*—Hamilton, Brook, Smith & Reynolds, P.C.

(57) ABSTRACT

A flexible cable for conducting a high-voltage from a high-voltage source to a machine or item of equipment requiring high-voltage operation, such as an x-ray source for medical or industrial applications, an ion accelerator, or similar item of medical, industrial, or scientific equipment. The cable includes a cable core which has at least one core conductor, at least one internal insulating layer surrounding the cable core, the internal insulating layer comprising a cross-linked very-low-density polyethylene material, a conductive shield surrounding the internal insulating layer, and an outer insulating jacket. The very-low-density polyethylene material includes a silane material for facilitating the cross-linking. The very-low-density polyethylene material can have a dielectric constant that is less than 3, and preferably less than about 2.3.

20 Claims, 1 Drawing Sheet

FLEXIBLE HIGH-VOLTAGE CABLE

RELATED APPLICATIONS

This application claims the benefit of U.S. Provisional Application No. 60/377,909, filed May 3, 2002, the entire teachings of which are incorporated herein by reference.

BACKGROUND OF THE INVENTION

Numerous items of medical, industrial, and scientific equipment require the delivery of high voltages from an external high-voltage source. In order to deliver these high voltages, special high-voltage cables (characterized by, for example, internal electric fields of greater than about 4000 V/mm) have been developed for this purpose. In general, it is desired that the high-voltage cables are characterized by good insulating properties. Also, it is often required that the cables possess sufficient flexibility to sustain bends and turns in the pathway between the high-voltage source and the item of equipment, and also to permit flexing of the cable during operation.

Traditionally, flexible high-voltage cables have employed an internal insulating material that is made of a rubber elastomeric material, such as ethylene-propylene rubber (EPR) or ethylene-propylene-diene monomer (EPDM). These materials provide the cable with good flexibility. One disadvantage of these rubber insulations, however, is that they are difficult and expensive to produce. Manufacturing these rubber insulations generally requires dedicated facilities and expensive rubber-producing equipment. Other alternative materials, such as paper and oil and plastic and oil laminations, are also problematic and expensive to produce.

An alternative, less expensive approach is to use conventional thermoplastic processing techniques and equipment to produce an insulating material from a thermoplastic compound. One disadvantage of this, however, is that conventional thermoplastic insulating material is very stiff relative to a rubber insulator. Thus, conventional thermoplastic insulations are not ideal for flexible high-voltage cable.

SUMMARY OF THE INVENTION

The present invention relates to a flexible cable for conducting a high-voltage from a high-voltage source to a machine or item of equipment requiring high-voltage operation, such as an x-ray source for medical or industrial applications, an ion accelerator, or similar item of medical, industrial, or scientific equipment. The cable includes a cable core which comprises at least one core conductor, at least one internal insulating layer surrounding the cable core, the internal insulating layer comprising a cross-linked very-low-density polyethylene material, a conductive shield surrounding the internal insulating layer, and an outer insulating jacket. According to one embodiment, the very-low-density polyethylene material also includes a silane material for facilitating the cross-linking. According to another aspect, the very-low-density polyethylene material has a dielectric constant that is less than 3, and preferably less than about 2.3.

The high-voltage cable of the present invention exhibits significantly improved flexibility over known high-voltage cables using a thermoplastic material, such as polyethylene, as an internal insulator. At the same time, the insulating material of the invention generally has a low relative dielectric constant (e.g. <3, and preferably less than about 2.3), which compares favorably with conventional rubber insulators used in high-voltage cables, which typically have relative dielectric constants of about 3.

The low dielectric constant of the present insulator provides significant advantages for a high-voltage cable. In the context of a high voltage cable, a low dielectric constant for the internal insulator is desired, as this will reduce the capacitance of the cable. With a lower capacitance, there is less stored energy in the cable, which reduces the risk of serious damage resulting from a failure of the cable, equipment, or the high-voltage source. Also, less capacitance means that the cable voltage (and thus the equipment voltage) can be fully charged and discharged much faster than in conventional cables.

Furthermore, the very-low-density polyethylene insulating material of the present invention possesses the desired characteristics of a traditional rubber insulating material (i.e. high-flexibility), but unlike a rubber insulator, it can be easily and inexpensively manufactured using conventional thermoplastic processing and manufacturing techniques.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention. All parts and percentages are by weight unless otherwise indicated.

DETAILED DESCRIPTION OF THE INVENTION

A description of preferred embodiments of the invention follows.

Figure 1:
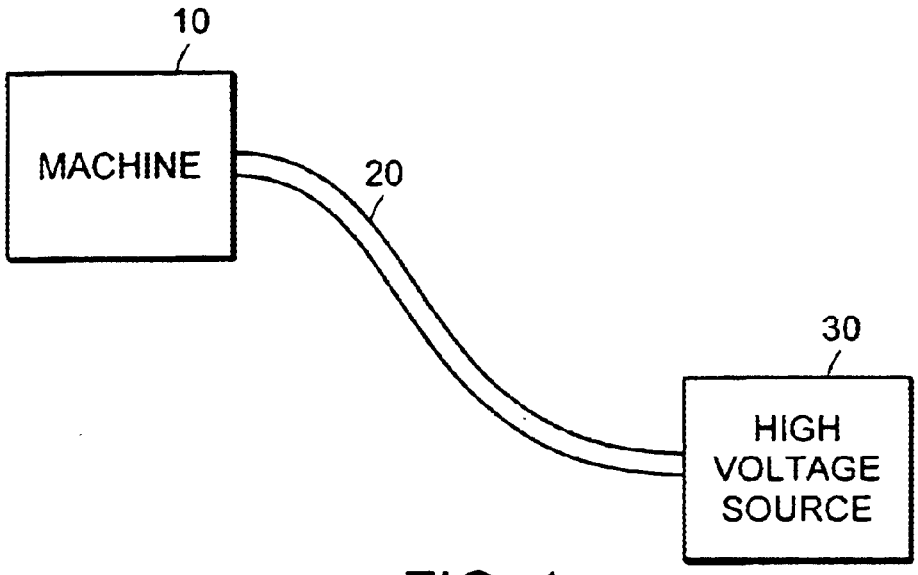
FIG. 1 is a schematic diagram of an electrical connection between a high-voltage power source and a machine, the connection being made via a flexible high-voltage cable of the present invention.

FIG. 1 illustrates schematically a machine 10, which could be an x-ray source for medical imaging, an ion accelerator, or any other item of medical, industrial, or scientific equipment which requires high-voltage operation. The machine 10 is electrically connected to high voltage power source 30 via a flexible, high-voltage cable 20. In general, the high-voltage cable is capable of supporting a voltage at relatively high stresses without electrical discharge or failure. Also, as shown in FIG. 1, the cable 20 possesses sufficient flexibility to permit the cable to make numerous bends and turns as it follows the path from the high voltage source 30 to the machine 10. In one aspect, the cable of the present invention allows for a minimum bend radius of approximately 3 times the cable diameter.

Figure 2:
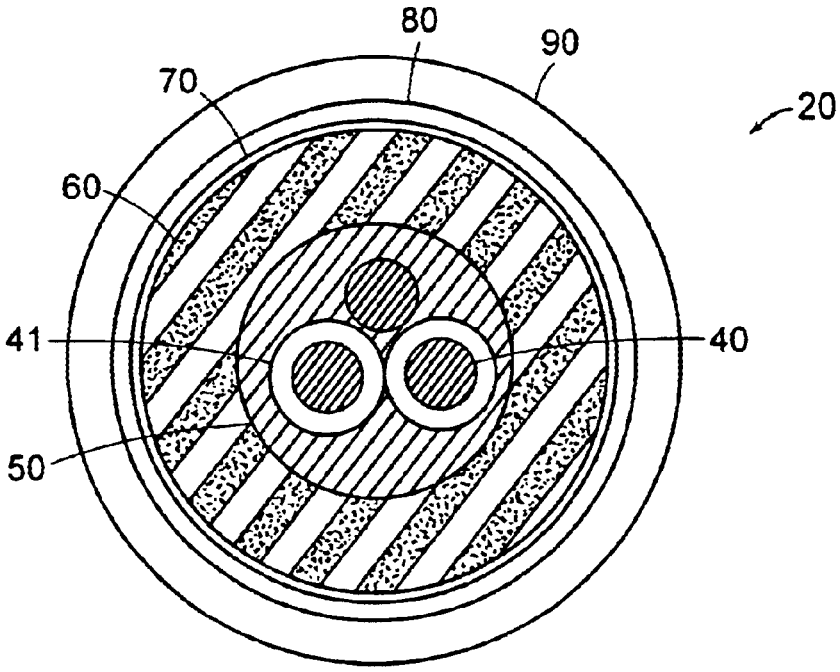
FIG. 2 is a cross-sectional view of one embodiment of a high-voltage cable of the present invention.

Turning to FIG. 2, a cross-section of a high-voltage cable 20 of the present invention is shown. In one embodiment, the cable comprises three core conductors 40, including two conductors of a conductive material (for example, copper) covered by an insulating layer 41 of thermoplastic rubber (TPR) or other suitable material. This embodiment also includes a third uninsulated core conductor. The three core conductors 40 are twisted together to form a cable core. It will be understood, however, that various modifications can be made in the design of the cable core, and the present invention is intended to include cables having a single core conductor, or a plurality of core conductors, wherein any number of the conductors can optionally include an insulating layer 41 as shown here.

The cable core can be covered by three successive layers of a silane-cured polyethylene material 50, 60, 70, described in greater detail below. In general, polyethylene layers 50 and 70 are semiconductive layers which are very-low-density polyethylene materials combined with carbon to provide the semiconducting properties. Layer 60 comprises very-low-density polyethylene which has not been combined with carbon, and functions as an insulating layer. A metallic shield 80 is braided over the outer semiconducting layer 70, and the cable in one embodiment is covered with a polyvinyl chloride (PVC) jacket 90.

A method of manufacturing the flexible, high-voltage cable 20 of FIG. 2 is now described. First, individual strands of wire are twisted together to form each core conductor 40. Two lengths of the conductor are then insulated by extruding a first layer 41 of TPR (or other suitable insulator) over a first conductor, and a second layer 41 of TPR (or other suitable insulator) over a second conductor. The two insulated conductors, and the third (non-insulated) conductor, are then twisted together to form the cable core.

Next, an insulating system comprising three layers of the very-low-density polyethylene material 50, 60, 70 is applied to the cable core, such as by extrusion. In general, the very-low-density polyethylene material is made from a homogeneous mixture having as its major constituent (i.e. preferably about 70% or more) a very low density polyethylene material. This mixture can also include additional resins comprising about 30% or less of the mixture. In general, the density of the very-low-density polyethylene material is less than about 0.90 g/cm$^3$. Preferably, the density of the very-low-density polyethylene material is less than about 0.88 g/cm$^3$. This homogeneous mixture additionally includes grafts of a silane compound, which facilitates cross-linking of the polyethylene resin after extrusion onto the cable. A suitable silane-grafted, very-low-density polyethylene material for use in the present invention is available from AEI Compounds, Ltd., of Gravesend, Kent, UK.

To produce the first semiconducting layer 50 of the insulating system, the silane-grafted very-low-density semiconducting polyethylene material is introduced into a suitable extruder, as is known in the field of thermoplastic processing and manufacture. The first layer 50 of this semiconductive polyethylene mixture is then extruded over the cable core. The second, thick insulating layer 60 is then produced by introducing the silane-grafted very-low-density insulating polyethylene material into the extruder, and extruding this material over the first layer 50. The third, thin semiconductive layer 70 is produced by introducing the silane-grafted, very-low-density semiconducting polyethylene material into the extruder, and extruding this semiconductive material over the insulating layer 60.

The polyethylene material is then cross-linked by placing the cable, with the extruded polyethylene layers, in a warm, moist environment. In a preferred embodiment, the cable is immersed in a hot water bath at a temperature of between about 60° and 80° C. In this environment, the silane material facilitates cross-linking of the very-low-density polyethylene material. Preferably, the gel content (degree of cross-linking) of the cross-linked polyethylene insulating material is between about 65 and 75%.

After the cable is removed from the hot water bath, a metallic (e.g. copper) shield 80 is braided over the cross-linked polyethylene semiconducting layer 70. An insulating jacket 90 is then extruded over the shield 80.

The use of a cross-linked very-low-density polyethylene material for the insulating layer(s) allows the production of a highly-flexible cable, while simultaneously providing a low relative dielectric constant (K). Insulators having low dielectric constants are advantageous for use in high-voltage cables, as a low dielectric constant reduces the capacitance, and hence the stored energy, in the cable. In general, the relative dielectric constant of the cross-linked very-low-density polyethylene insulator of the present invention is less than about 3, and is preferably less than about 2.3. The use of an insulator having a relative dielectric constant of 2.3 yields cables with approximately 23% less capacitance than rubber equivalents.

While this invention has been particularly shown and described with references to preferred embodiments thereof, it will be understood by those skilled in the art that various changes in form and details may be made therein without departing from the scope of the invention encompassed by the appended claims.

What is claimed is:

1. A flexible cable for conducting a high-voltage from a high-voltage source to an item of equipment requiring high-voltage operation, comprising:

a conductive cable core;

an insulating layer surrounding the cable core, the insulating layer comprising a cross-linked very-low-density polyethylene material;

a conductive shield surrounding the insulating layer; and an outer insulating jacket, the flexible cable having a minimum bend radius that is less than or equal to approximately three times the diameter of the cable.

2. The flexible cable of claim 1, wherein the insulating layer has a relative dielectric constant that is less than about 3.

3. The flexible cable of claim 2, wherein the insulating layer has a relative dielectric constant that is less than about 2.3.

4. The flexible cable of claim 1, wherein the density of the very-low-density polyethylene material is less than about 0.90 g/cm$^3$.

5. The flexible cable of claim 4, wherein the density of the very-low-density polyethylene material is less than about 0.88 g/cm$^3$.

6. The flexible cable of claim 1, wherein the insulating layer comprises at least about 70% of a very-low-density polyethylene material.

7. The flexible cable of claim 1, further comprising:

an item of equipment electrically coupled to an end of the flexible cable.

8. The flexible cable of claim 7, wherein the item of equipment comprises an x-ray generator.

9. A flexible cable for conducting a high voltage from a high voltage source an item of equipment requiring high voltage operation, comprising a conductive cable core;

an internal insulating layer surrounding the cable core, the insulating layer comprising a cross linked very low density polyethylene material and a silane material;

a conductive shield surrounding the internal insulating layer; and an outer insulating jacket, wherein the flexible cable having a minimum bend radius that is less than or equal to approximately three times the diameter of the cable.

10. A system for delivering a high-voltage to an item of equipment, comprising:

an item of equipment; and a flexible cable having a first end and a second end, the first end electrically coupled to the item of equipment and the second end adapted to be electrically coupled to a high-voltage source, the flexible cable having a minimum bend radius that is less than or equal to approximately three times the diameter of the cable, the flexible cable comprising:

a conductive cable core;

an insulating layer surrounding the cable core, the insulating layer comprising a cross-linked very-low-density polyethylene material;

a conductive shield surrounding the insulating layer; and an outer insulating jacket.

11. The system of claim 10, wherein the item of equipment comprises an x-ray generator.

12. The system of claim 10, wherein the item of equipment comprises an ion accelerator.

13. The system of claim 10, further comprising a high-voltage source electrically coupled to the second end of the cable.

14. A method of delivering a high-voltage from a high-voltage source to an item of equipment requiring high-voltage operation, comprising:

providing a flexible cable having a first end and a second end, the first end electrically coupled to the item of equipment and the second end electrically coupled to the high-voltage source, the flexible cable having a minimum bend radius that is less than or equal to approximately three times the diameter of the cable, the flexible cable comprising a conductive cable core; an insulating layer surrounding the cable core, the insulating layer comprising a cross-linked very-low-density polyethylene material; a conductive shield surrounding the insulating layer; and an outer insulating jacket; and conducting a high-voltage from the high-voltage source through the flexible cable to the item of equipment.

15. A method of manufacturing a flexible cable, comprising:

providing a conductive cable core;

forming an insulating layer over the cable core, the insulating layer comprising a very low density polyethylene material;

cross linking the very low density polyethylene material of the insulating layer;

providing a conductive shield over the insulating layer; and providing an insulating jacket over the conductive shield, wherein the flexible cable having a minimum bend radius that is less than or equal to approximately three times the diameter of the cable.

16. The method of claim 15, further comprising introducing a silane material to the very-low-density polyethylene material to facilitate the cross-linking step.

17. The method of claim 15, wherein the cross-linking is performed in a warm, moist environment.

18. The method of claim 15, further comprising extruding the very-low-density polyethylene material over the cable core, and then introducing the cable core to a warm, moist environment to facilitate cross-linking of the very-low-density polyethylene material.

19. The method of claim 18, wherein the step of introducing the cable core into a warm, moist environment comprises immersing the cable core in a hot water bath at a temperature of between 60° and 80° C.

20. The method of claim 15, wherein the gel content of the cross-linked insulating layer is between about 65 and 75%.

* * * * *